US007355553B1

(12) United States Patent
Ryken, Jr. et al.

(10) Patent No.: US 7,355,553 B1
(45) Date of Patent: Apr. 8, 2008

(54) TEN INCH DIAMETER MICROSTRIP ANTENNA

(75) Inventors: Marvin L. Ryken, Jr., Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/645,266

(22) Filed: Dec. 6, 2006

(51) Int. Cl.
*H01Q 1/28* (2006.01)
*H01Q 1/38* (2006.01)

(52) U.S. Cl. ..... 343/705; 343/700 MS

(58) Field of Classification Search ..... 343/705, 343/708, 700 MS, 846, 853, 829
See application file for complete search history.

(56) References Cited

U.S. PATENT DOCUMENTS

| | | | | |
|---|---|---|---|---|
| 6,549,168 | B1 * | 4/2003 | Ryken et al. | 343/700 MS |
| 6,621,456 | B2 * | 9/2003 | Ryken et al. | 343/705 |
| 7,109,929 | B1 * | 9/2006 | Ryken et al. | 343/700 MS |
| 2006/0250306 | A1 * | 11/2006 | Ryken et al. | 343/700 MS |

* cited by examiner

*Primary Examiner*—Hoang V Nguyen
(74) *Attorney, Agent, or Firm*—David S. Kalmbaugh

(57) ABSTRACT

A microstrip antenna configured to wrap around approximately 270 degrees a projectile's body without interfering with the aerodynamic design of the projectile. The microstrip antenna has two identical grounded quarter wavelength microstrip antenna elements positioned around the circumference of the projectile's body. The antenna has an operating frequency of 425 MHz ±375 KHz, a maximum diameter of ten inches and a maximum length of nine inches. The microstrip antenna outputs a pair of equal amplitude flight termination signals and produces a quasi omni-directional radiation pattern with linear polarization.

20 Claims, 4 Drawing Sheets

TEN INCH DIAMETER MICROSTRIP ANTENNA

BACKGROUND OF THE INVENTION

1. Field of the Invention

The present invention relates generally to a microstrip antenna for use on a projectile, such as a missile. More particularly, the present invention relates to a ten inch diameter microstrip antenna which has a operating frequency of 425 megahertz.

2. Description of the Prior Art

There is currently a requirement for a microstrip antenna which produces a quasi omni-directional radiation pattern with linear polarization. The microstrip antenna must be a conformal 270 degree wrap around antenna with a ten inch maximum diameter and a five inch maximum length. The antenna's required frequency of operation is 425 MHz ±375 KHx. For reliability purposes, two outputs from the microstrip antenna are required with integrated power division. The antenna is to be used as a flight termination system (FTS) antenna.

Generally, a microstrip antenna operates by resonating at a frequency. The conventional design for microstrip antennas uses printed circuit board techniques which include putting a printed copper patch on the top of a layer of dielectric and a copper ground plane on the underside of the dielectric. The frequency of operation of the conventional microstrip antenna is for the length of the antenna to be a half-wavelength in the microstrip medium of dielectric below the patch and air above the patch. A quarter-wavelength microstrip antenna is similar to the half wavelength microstrip antenna except the resonant length is a quarter-wavelength and one side of the antenna is grounded.

Presently, there is no known microstrip antenna which meets the dimensions and frequency requirements set forth for this particular flight termination system antenna.

SUMMARY OF THE INVENTION

The present invention overcomes some of the difficulties of the past including those mentioned above in that it comprises a relatively simple yet highly effective microstrip antenna which is adapted for use on a ten inch diameter projectile. The microstrip antenna comprising the present invention is configured to wrap around approximately 270 degrees of a projectile's body without interfering with the aerodynamic design of the projectile.

The microstrip antenna of the present invention includes two grounded quarter wavelength microstrip antenna elements positioned around the projectile's body. The antenna has an operating frequency of 425 MHz ±375 KHz, a maximum diameter of ten inches, a thickness of 0.22 inches and a maximum length of five inches. The microstrip antenna produces a quasi omni-directional radiation pattern with linear polarization.

The two quarter wavelength microstrip antenna elements each have their signal outputs connected to a power divider. The power divider is a Wilkinson type with a 100 ohm resistor for isolation. The electrical output signal from the quarter wavelength microstrip antennas are first divided equally and then added together resulting in a pair of equal amplitude electrical signals which are supplied to a pair of redundant flight termination system receivers on board the missile. The 100 ohm resistors isolate the two receiver outputs and add no resistive load to the power split, so that the transmission lines from the antenna elements to the signal outputs of the antenna are almost 100% efficient.

DETAILED DESCRIPTION OF A PREFERRED EMBODIMENT

Figure 1:
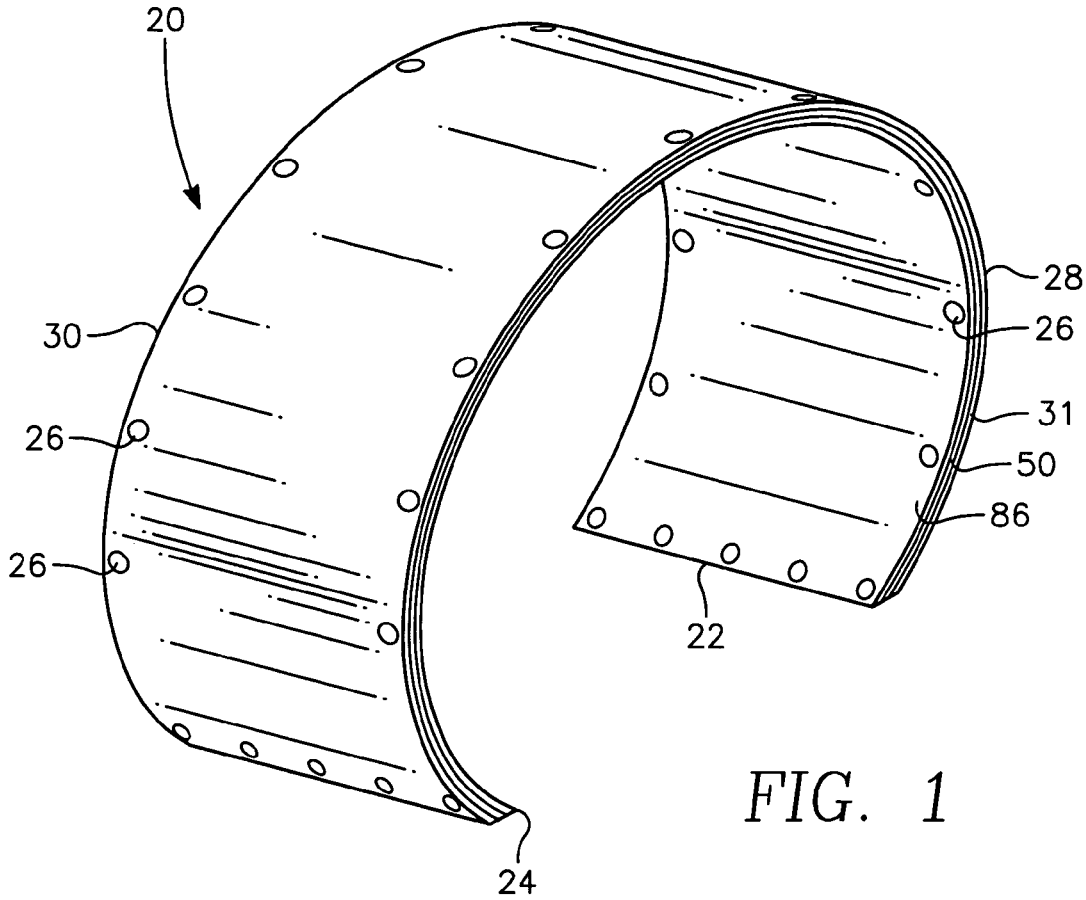
FIG. 1 is a perspective view illustrating a 10-inch diameter conformal wrap around microstrip antenna with an operating frequency of 425 MHz which comprises a preferred embodiment of the invention.

Referring to FIG. 1, there is shown a perspective view of the ten inch diameter microstrip antenna 20 which has an operating frequency of 425 MHz ±375 KHz. Microstrip antenna 10 is a conformal wrap-around antenna which has a maximum diameter of ten inches, a thickness of 0.22 inches and an overall length of five inches. As shown in FIG. 1, antenna 20 is 270 degrees in circumference with a 90 degree gap between adjacent edges 22 and 24 of antenna 20. Microstrip antenna 20 produces a quasi omni-directional radiation pattern with linear polarization.

Antenna 20 also includes eyelets 26 located in proximity to the edges 22, 24, 28 and 30 of antenna 20. The eyelets 27 strengthen the antenna's dielectric material for screws used to mount antenna 20 to a projectile, such as a missile.

Antenna 20 is designed to operate as a flight termination antenna with a center frequency of 425 MHz. In the event that a failure occurs during a missile test flight, a monitoring station can initiate a flight termination action to destroy the missile. The signal to terminate the missile's flight is an RF signal transmitted at a frequency of approximately425 MHz.

Figure 2:
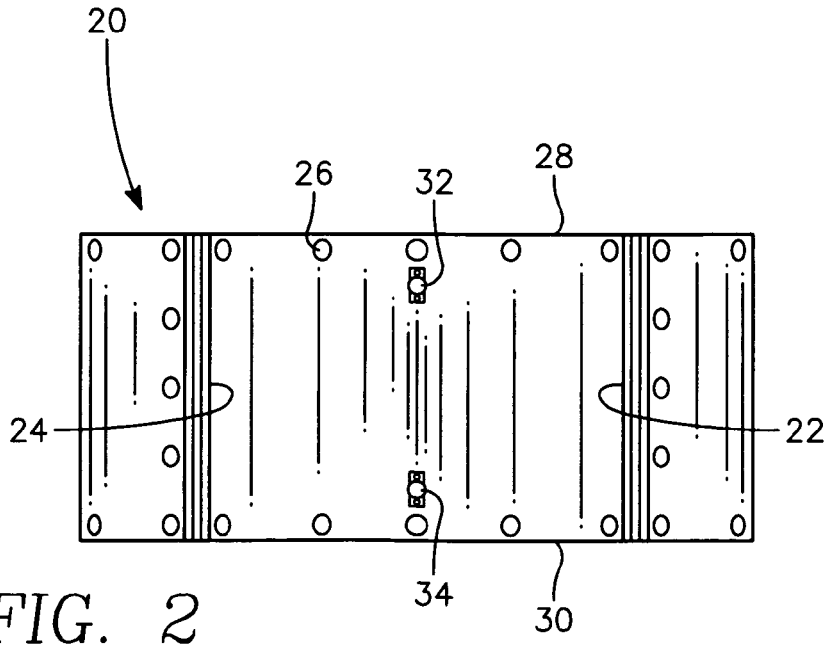
FIG. 2 is an inside vie of the 425 MHz microstrip antenna of FIG. 1 which shows the input connectors for the microstrip antenna.

Referring to FIG. 2, FIG. 2 is an inside view of the 425 MHz microstrip antenna 20 of FIG. 1 which shows a pair of SMA female connectors 32 and 34 for the two electrical signal outputs 35 and 37 (FIG. 5) from microstrip antenna 20. The flight termination signal received by microstrip antenna 20 is provided to the missile's on board data processing electronics via the SMA female connectors 32 and 34 as electrical output signals from microstrip antenna 20.

Referring to FIGS. 1 and 2, 425 MHz microstrip antenna 20 has three printed circuit boards layers. The outside Printed Circuit Board (PCB) layer 31 is a protective layer or cover for antenna 20. The outside layer 31 has a thickness of 0.093 inches and is fabricated from Rogers Corporation RT/5870. The middle PCB layer 50 is the Circuit Printed Circuit Board and the inside PCB layer 86 is the Ground Printed Circuit Board. Both the Circuit and Ground Printed Circuit Boards are made from Rogers Corporation's Duriod RT/6002 with a 0.060-inch thickness clad with one-ounce copper. The material used for the Circuit and Ground Printed Circuit Boards 50 and 86, respectively, were selected because of their extremely stable properties with respect to temperature. Two layers are required because a thickness in excess of 0.060-inch would result in cracking when the Printed Circuit Boards 50 and 86 are bent into the configuration required for antenna 20.

Figure 3:
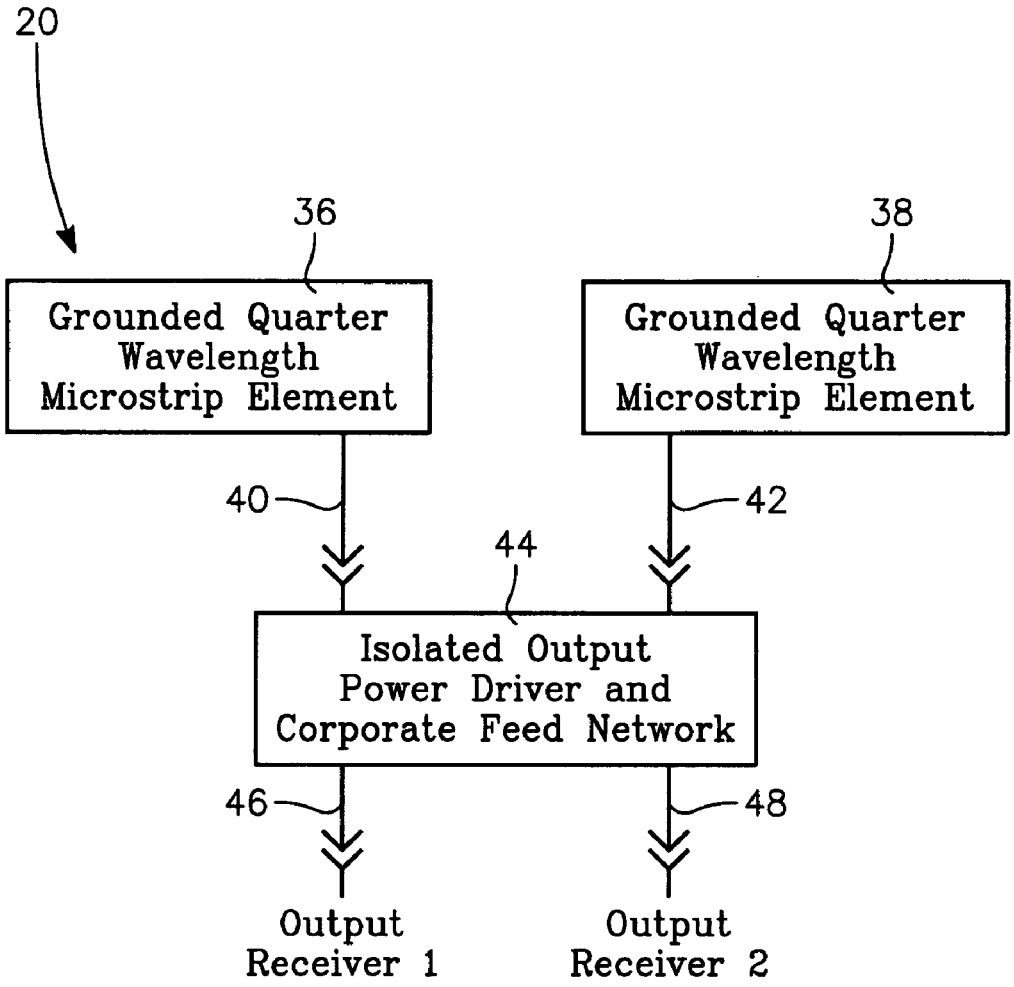
FIG. 3 is a block diagram of electrical elements of the 425 MHz microstrip antenna of FIG. 1.

Referring to FIG. 3, FIG. 3 shows an electrical block diagram of 425 MHz microstrip antenna 20. Antenna has two grounded quarter wavelength microstrip antenna elements 36 and 38 which have their signal outputs 40 and 42 connected to a power divider and corporate feed network 44. Two signals are output from power divider and corporate feed network 44. An output signal line or cable 46 connects the power divider and corporate feed network 44 to one of the missile's receivers. Similarly, an output signal line or cable 48 connects the power divider and corporate feed network 44 to the missile's other receiver.

The fight termination system for a missile is a dual redundant system which necessitates dual outputs from power divider and corporate feed network 44. This insures that the missile will destruct upon receiving a flight termination signal even when there is a failure in one of the two receivers on board the missile.

Figure 4:
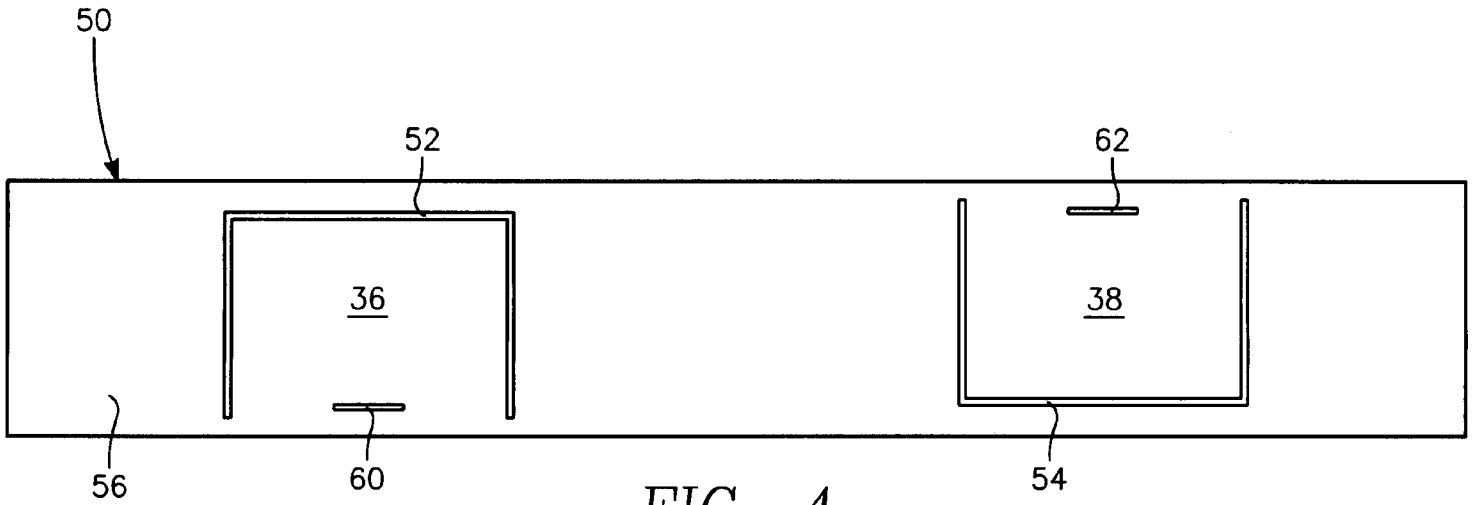
FIG. 4 is a view illustrating the top layer of the circuit board of the 425 MHz microstrip antenna of FIG. 1.

Referring to FIG. 4, the top layer of the circuit board 50 includes the microstrip antenna elements 36 and 38 which operate at a 425 MHz center frequency. Antenna elements 36 and 38 are generally rectangular shaped copper plated radiating elements.

A three sided dielectric gap 52 is formed at the edge of antenna element 36 with the antenna elements's electric field being confined primarily to the dielectric gap 52. The length of the gap's sides on the upper surface of circuit board 50 are configured so that antenna element 36 operates as a quarter wavelength microstrip antenna element.

Similarly, a three sided dielectric gap 54 is formed at the edge of antenna element 38 with the antenna element's electric field being confined primarily to the dielectric gap 54. The length of the gap's sides on the upper surface of circuit board 50 are configured so that antenna element 38 20 operates as a quarter wavelength microstrip antenna.

The quarter wavelength resonators 36 and 38 extends from the center portion of gap 52 or gap 54 near the top edge (gap 52) or the bottom edge (gap 54) of circuit board 50 to the opposite edge of circuit board 50. The remaining copper plating 56 outside of the dielectric gasp 52 and 54 is maintained at ground potential which provides the ground for antenna elements 36 and 38.

Antenna element 36 has a slot loading dielectric gap 60 which is parallel to and in proximity to the bottom edge of circuit board 60. Antenna element 38 also has a slot loading gap 62 which is parallel to and in proximity to the top edge of circuit board 60. Gaps 60 and 62 are included in the antenna design to insure operation of antenna 20 at the required frequency of operation of approximately 425 MHz.

Antenna elements 36 and 38 are positioned on circuit board 50 such that antenna element 36 is rotated 180 degrees from antenna element 38. The antenna elements 36 and 38 are positioned in this manner to insure that the electric field generated by the RF signals received by elements 36 and 38 is continuous around the circumference of the missile.

Figure 5:
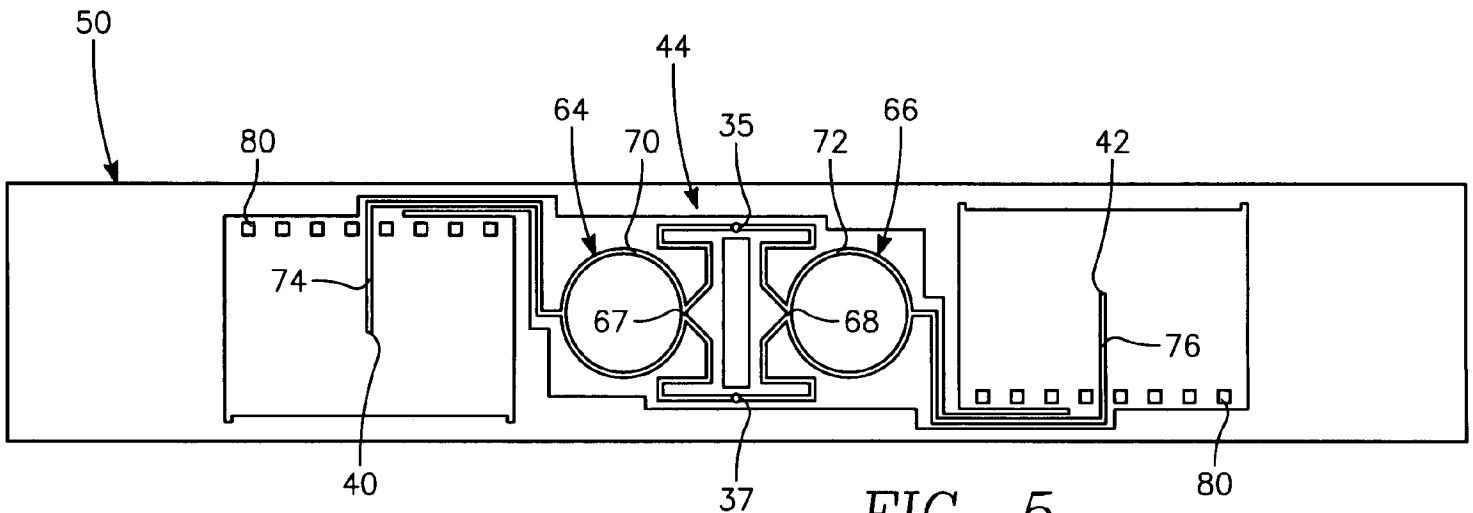
FIG. 5 is a view illustrating the bottom layer of the circuit board of the 425 MHz microstrip antenna of FIG. 1.

Referring to FIGS. 4 and 5, the bottom layer of circuit board 50 includes the copper plate power divider and corporate feed network 44 for antenna elements 36 and 38. The power divider and corporate feed network 44 for the antenna elements 36 and 38 includes a pair of Wilkinson power dividers 64 and 66. Wilkinson power dividers 64 and 66 insure isolation between the two electrical signal outputs 35 and 37 from microstrip antenna 20. Two 100 ohm resistors 67 and 68 are used to provide isolation between the two electrical signal outputs 35 and 37.

The two one hundred ohm resistors 67 and 68 are positioned on the bottom layer of circuit board 50 at a point where the two circles 72 and 74 of the transmission lines 76 and 78 of feed network 44 join together before the feed network 44 splits apart and connects to the electrical signal outputs 35 and 37. Transmission lines 74 and 76 of feed network 44, which connect each antenna element 36 and 38 to the electrical signal outputs 35 and 37 are configured as quarter-wavelength transmission lines and are copper plated.

Utilizing the two Wilkinson power dividers 64 and 66, the electrical signal outputs from quarter wavelength microstrip antenna elements 36 and 38 are first divided equally and then added together with isolation between the two electrical signal outputs 35 and 37. The resistors 67 and 68 in a Wilkinsoin power combiner or splitter add no resistive load to a power split, so that the transmission lines 74 and 76 from the antenna elements 36 and 38 to the signal outputs 35 and 37 are almost 100% efficient.

Figure 8:
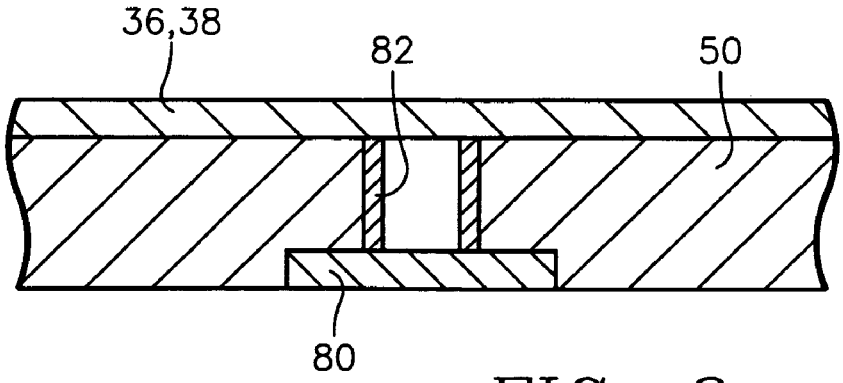
FIG. 8 is a sectional view of the circuit board of FIG. 5 which illustrates one of the tuning tabs and the via which connects the running tab to one of the quarter wavelength microstrip antenna elements on the upper surface of circuit board of FIG. 4.

Referring to FIGS. 4, 5 and 8, the bottom layer of circuit board 50 has a plurality of tuning tabs 80 which are square copper patches used to fine tune the operating frequency of each quarter wavelength microstrip antenna 36 and 38. Tuning tabs 80 are copper shaped squares having dimensions of 0.201 inches by 0.201 inches. Each tuning tab 80 allows the quarter wavelength microstrip antenna elements 36 and 38 to be fine tuned by approximately 1.5 MHz per tab.

Due to manufacturing tolerances of the antenna, tuning of the antenna's frequency to the operating frequency is required. As shown in FIG. 8, a plated through via 82 connects the tuning tab 80 to the quarter wavelength antenna element 36 or 38. By drilling out the plated through hole 82, the tab 80 is disconnected from the quarter wavelength resonator 36 or 38 and a small amount of capacity is removed from the antenna elements 36 and 38 of microstrip antenna 20. The reduction in capacity results in a change in the frequency of the microstrip antenna elements 36 and 38 tuning the frequency upward by approximately 1.5 MHz.

Figure 6:
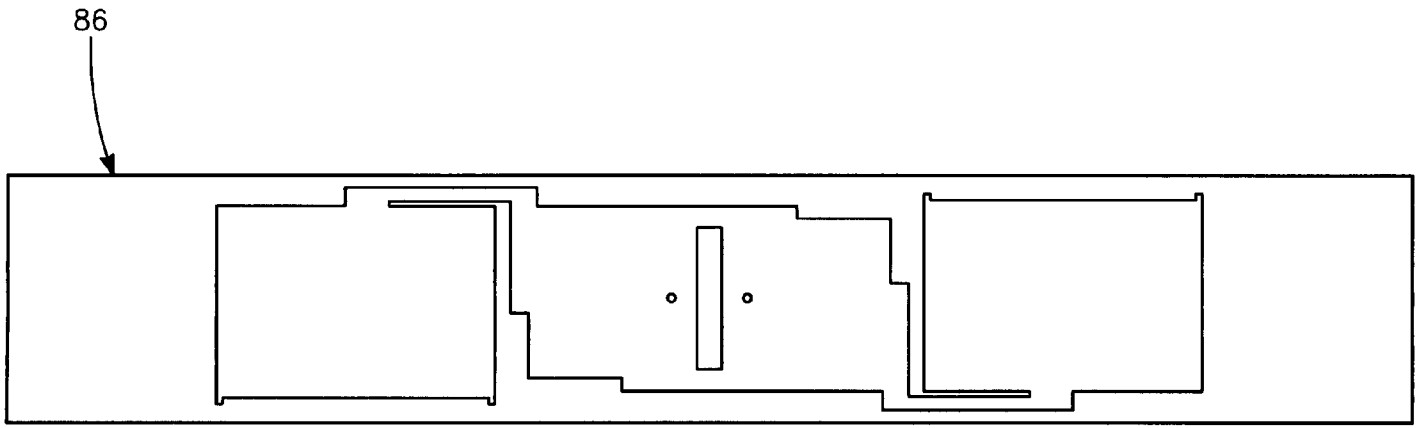
FIG. 6 is a view illustrating the top layer of the ground board of the 425 MHz microstrip antenna of FIG. 1.

Referring to FIGS. 2 and 6, the bottom layer of ground board 86 is solid copper plating with a clearance hole around each output 35 and 37. The clearance holes for outputs 35 and 37 are designed for cable connectors 32 and 34. The top layer of ground board 86 which is depicted in FIG. 6 is virtually identical to the bottom layer of circuit board 50 except it does not have the tuning square patches 80. The ground board 86 and the circuit board 50 have copper plated sides since ground board 86 and circuit board 50 form the bulk of the antenna element's resonant structure. The copper plated sides provide the grounding for quarter wavelength microstrip antenna elements 36 and 38 of antenna 20.

The printed circuit boards 31, 50 and 86 of antenna 20 are gold plated to protect the copper from environmental conditions and high bonding temperatures.

Figure 7:
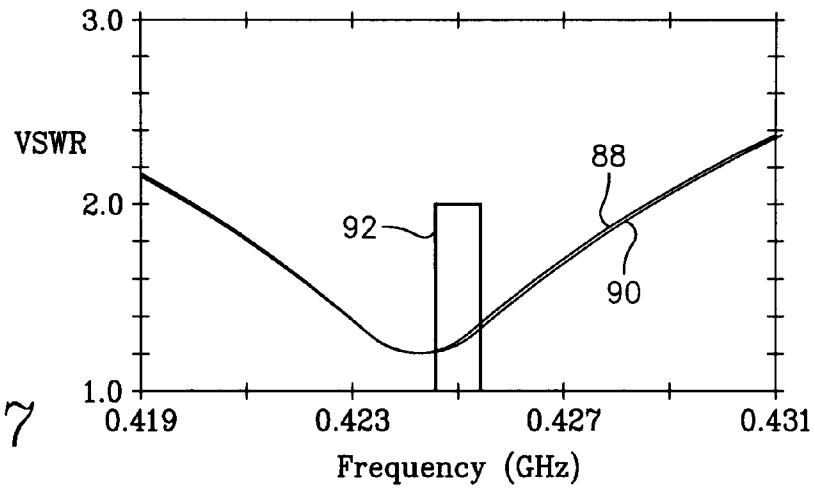
FIG. 7 is are voltage standing wave ratio plots for the 425 MHz microstrip antenna of FIG. 1.

Referring to FIG. 7 illustrates the voltage standing wave ratios 88 and 90 for the two antenna elements 36 and 38 of antenna 20. The voltage standing wave ratio is between 1.2 and 1.4 around the operating frequency of the antenna, which is 425 MHz ±375 KHz (as is best indicted by that portion of plots 88 and 90 within the specified operating frequency 92.

From the foregoing, it is readily apparent that the present invention comprises a new, unique, and exceedingly useful 10-inch diameter 425 MHz Antenna, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A microstrip antenna adapted for use on a projectile comprising:

(a) a first dielectric layer operating as a protective layer for said microstrip antenna wherein said first dielectric layer is positioned around an outer surface of said projectile;

(b) a second dielectric layer positioned below said first dielectric layer around the outer surface of said projectile, said second dielectric layer having an upper surface and a lower surface;

(c) a pair of rectangular shaped quarter wavelength antenna elements mounted on the upper surface of said second dielectric layer, one of said pair of quarter wavelength antenna elements being rotated one hundred eighty degrees from the other of said pair of quarter wavelength antenna elements to produce a quasi omni-directional radiation pattern with linear polarization, said quarter wavelength antenna elements of said microstrip antenna having a signal output and an operating frequency of approximately 425 MHz ±375 KHz;

(d) a power divider and corporate feed network mounted on the lower surface of second dielectric layer, said power divider and corporate feed network being connected to the signal output of each of said quarter wavelength antenna elements to receiver a pair of RF equivalent electrical signal from said quarter wavelength antenna elements, said power divider and corporate feed network first dividing equally and then adding together said RF equivalent electrical signals to produce a pair of equal amplitude electrical signals; and (e) said power divider and corporate feed network including a pair of resistors which insure isolation between two electrical signal outputs from said microstrip antenna.

2. The microstrip antenna of claim 1 wherein said microstrip antenna is a conformal warp-around antenna which has a maximum diameter of ten inches, a thickness of 0.22 inches and an overall length of five inches.

3. The microstrip antenna of claim 2 wherein said microstrip antenna is configured to wrap around approximately 270 degrees of the outer surface of said projectile without interfering with the aerodynamic design of said projectile.

4. The microstrip antenna of claim 1 wherein a voltage standing wave ratio for said microstrip antenna is between 1.2 and 1.4 around the operating frequency of said microstrip antenna.

5. The microstrip antenna of claim 1 wherein said pair of resistors comprise 100 ohm resistors which insure isolation between the two electrical signal outputs from said microstrip antenna, and result in the two electrical signal outputs from said microstrip antenna being approximately 100% efficient.

6. A microstrip antenna adapted for use on a projectile comprising:

(a) a first dielectric layer operating as a protective layer for said microstrip antenna wherein said first dielectric layer is positioned around an outer surface of said projectile;

(b) a second dielectric layer positioned below said first dielectric layer around the outer surface of said projectile, said second dielectric layer having an upper surface and a lower surface;

(c) a pair of rectangular shaped quarter wavelength antenna elements mounted on the upper surface of said second dielectric layer, one of said pair of quarter wavelength antenna elements being rotated one hundred eighty degrees from the other of said pair of quarter wavelength antenna elements to produce a quasi omni-directional radiation pattern with linear polarization, said quarter wavelength antenna elements of said microstrip antenna having a signal output and an operating frequency of approximately 425 MHz ±375 KHz;

(d) a continuous gap formed around one edge and two sides of each of pair of quarter wavelength antenna elements, said continuous gap being configured so that each of said pair of quarter wavelength antenna elements operate at a quarter wavelength;

(e) a copper plated region formed outside of said gap on a remaining portion of the upper surface of said second dielectric layer, said copper plated region functioning as a ground for each of said pair of quarter wavelength antenna elements;

(f) each of said quarter wavelength antenna elements including a plurality of aligned tuning tabs mounted on the bottom surface of said second dielectric layer, each of said tuning tabs for each of said quarter wavelength antenna elements having a plated through via which passes through said second dielectric layer to said quarter wavelength antenna element to connect said tuning tab to said quarter wavelength antenna element;

(g) a power divider and corporate feed network mounted on the lower surface of second dielectric layer, said power divider and corporate feed network being connected to the signal output of each of said quarter wavelength antenna elements to receive a pair of RF equivalent electrical signal from said quarter wavelength antenna elements, said power divider and corporate feed network first dividing equally and then adding together said RF equivalent electrical signals to produce a pair of equal amplitude electrical signals; and (h) said power divider and corporate feed network including a pair of resistors which insure isolation between two electrical signal outputs from said microstrip antenna.

7. The microstrip antenna of claim 6 wherein said microstrip antenna is a conformal wrap-around antenna which has a maximum diameter of ten inches, a thickness of 0.22 inches and an overall length of five inches.

8. The microstrip antenna of claim 7 wherein said microstrip antenna is configured to wrap around approximately 270 degrees of the outer surface of said projectile without interfering with the aerodynamic design of said projectile.

9. The microstrip antenna of claim 6 wherein a voltage standing wave ratio for said microstrip antenna is between 1.2 and 1.4 around the operating frequency of said microstrip antenna.

10. The microstrip antenna of claim 6 wherein said pair of resistors comprise 100 ohm resistors which insure isolation between the two electrical signal outputs from said microstrip antenna, and result in the two electrical signal outputs from said microstrip antenna being approximately 100% efficient.

11. The microstrip antenna of claim 6 wherein the operating frequency for said microstrip antenna is tuned by selectively removing the plated through vias for each of said pair of quarter wavelength elements from said second dielectric layer, wherein selectively removing the plated through vias for each of said pair of quarter wavelength antenna elements disconnects said tuning tabs from said quater wavelength antenna elements which results in a change in the frequency of operation of said microstrip antenna.

12. A microstrip antenna adapted for use on a projectile comprising:

(a) a first dielectric layer operating as a protective layer for said microstrip antenna wherein said first dielectric layer is positioned around an outer surface of said projectile;

(b) a second dielectric layer positioned below said first dielectric layer around the outer surface of said projectile, said second dielectric layer having an upper surface and a lower surface;

(c) a pair of rectangular shaped quarter wavelength antenna elements mounted on the upper surface of said second dielectric layer, one of said pair of quarter wavelength antenna elements being rotated one hundred eighty degrees from the other of said pair of quarter wavelength antenna elements to produce a quasi omni-directional radiation pattern with linear polarization, said quarter wavelength antenna elements of said microstrip antenna having a signal output and an operating frequency of approximately 425 MHz ±375 KHz;

(d) a continuous gap formed around one edge and two sides of each of pair of quarter wavelength antenna elements, said continuous gap being configured so that each of said pair of quarter wavelength antenna elements operate at a quarter wavelength;

(e) a copper plated region formed outside of said gap on a remaining portion of the upper surface of said second dielectric layer, said copper plated region functioning as a ground for each of said pair of quarter wavelength antenna elements;

(f) each of said quarter wavelength antenna elements including a plurality of aligned tuning tabs mounted on the bottom surface of said second dielectric layer, each of said tuning tabs for each of said quarter wavelength antenna elements having a plated through via which passes through said second dielectric layer to said quarter wavelength antenna element to connect said tuning tab to said quarter wavelength antenna element;

(g) a power divider and cooperate feed network mounted on the lower surface of second dielectric layer, said power divider and corporate feed network being connected to the signal output of each of said quarter wavelength antenna elements to receiver a pair of RF equivalent electrical signal from said quarter wavelength antenna elements, said power divider and corporate feed network first adding together and then dividing equally said RF equivalent electrical signals to produce a pair of equal amplitude electrical signals; and (h) said power divider and corporate feed network including a pair of resistors which insure isolation between two electrical signal outputs from said microstrip antenna; and (i) a third dielectric layer positioned below said second dielectric layer around the outer surface of said projectile, said third dielectric layer having a bottom surface comprising solid copper plating, wherein said solid copper plating is a copper plated ground plane connected to the copper plated region for each of said quater wavelength antenna elements grounding the copper plated region for each of said quarter wavelength antenna elements.

13. The microstrip antenna of claim 12 wherein said power divider and corporate feed network includes the two electrical signal outputs, each of the two electrical signal outputs having a female connector adapted to receive a cable from a flight termination system within said projectile, said female connector being located within a clearance hole in said third dielectric layer.

14. The microstrip antenna of claim 13 wherein wherein said power divider and corporate feed network includes a pair of copper plated RF signal transmission lines, each of said RF signal transmission lines connecting one of said pair of quarter wavelength antenna elements to one of the two electrical signal outputs, said RF signal transmission lines being configured as quarter wavelength transmission lines.

15. The microstrip antenna of claim 12 wherein said microstrip antenna is a conformal wrap-around antenna which has a maximum diameter of ten inches, a thickness of 0.22 inches and an overall length of five inches.

16. The microstrip antenna of claim 12 wherein said microstrip antenna is configured to wrap around approximately 270 degrees of the outer surface of said projectile without interfering with the aerodynamic design of said projectile.

17. The microstrip antenna of claim 12 wherein a voltage standing wave ratio for said microstrip antenna is between 1.2 and 1.4 around the operating frequency of said microstrip antenna.

18. The microstrip antenna of claim 12 wherein said pair of resistors comprises 100 ohm resistors which insure isolation between the two electrical signal outputs from said microstrip antenna, and result in the two electrical signal outputs from said microstrip antenna being approximately 100% efficient.

19. The microstrip antenna of claim 12 wherein the operating frequency for said microstrip antenna is tuned by selectively removing the plated through vias for each of said pair of quarter wavelength elements from said second dielectric layer, wherein selectively removing the plated through vias for each of said pair of quarter wavelength antenna elements disconnects said tuning tabs from said quarter wavelength antenna elements which results in a change in the frequency of operation of said microstrip antenna.

20. The microstrip antenna of claim 12 wherein said first dielectric layer has a thickness of 0.093 inches, and said second dielectric layer and said third dielectric layer each have a thickness of 0.060 inches and are clad with one ounce copper.

* * * * *